US006535543B2

(12) United States Patent
Tischenko et al.

(10) Patent No.: US 6,535,543 B2
(45) Date of Patent: Mar. 18, 2003

(54) DEVICE TO TAKE IN FUMES AND COOL THE ROOF OF ELECTRIC FURNACES

(75) Inventors: Peter Tischenko, Donezk (UA); Angelico Della Negra, Povoletto (IT); Milorad Pavlicevic, Udine (IT); Alfredo Poloni, Fogliano Di Redipuglia (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 0 days.

(21) Appl. No.: 09/938,859

(22) Filed: Aug. 27, 2001

(65) Prior Publication Data

US 2002/0027939 A1 Mar. 7, 2002

(30) Foreign Application Priority Data

Aug. 29, 2000 (IT) ..... UD2000A000161

(51) Int. Cl.[7] ..... F27D 1/00

(52) U.S. Cl. ..... 373/73; 373/9; 373/74; 373/77

(58) Field of Search ..... 373/2, 8, 9, 71–74, 373/77; 266/158

(56) References Cited

U.S. PATENT DOCUMENTS 4,411,311 A * 10/1983 Touze ..... 373/74
4,649,807 A * 3/1987 Aasen et al. ..... 373/9
5,787,108 A * 7/1998 Pavlicevic et al. ..... 373/77
5,999,558 A * 12/1999 Miner et al. ..... 373/74
6,036,915 A * 3/2000 Kuhne et al. ..... 266/158
6,084,902 A 7/2000 Hawk ..... 373/74
6,175,584 B1 * 1/2001 Pavlicevic et al. ..... 266/158
6,327,296 B1 * 12/2001 Poloni et al. ..... 373/74

FOREIGN PATENT DOCUMENTS

EP 805325 11/1997
WO 0043719 7/2000

* cited by examiner

*Primary Examiner*—Tu Ba Hoang
(74) *Attorney, Agent, or Firm*—Stevens, Davis, Miller & Mosher, LLP

(57) ABSTRACT

Device to take in fumes and cool the roof (10) of electric furnaces. The device has a central aperture (11) into which an electrode can be inserted and a peripheral aperture (12) to take in and discharge the fumes. The device also has a first cooling system (13) for a central zone surrounding, and cooperating with, the central aperture (11), and a second system (15) to take in and convey the fumes. The first cooling system (13) includes a circular cyclone chamber (18) having a plurality of turns (19) able to cool the zone surrounding the central aperture (11).

21 Claims, 3 Drawing Sheets

DEVICE TO TAKE IN FUMES AND COOL THE ROOF OF ELECTRIC FURNACES

FIELD OF THE INVENTION

The invention concerns a device to take in fumes and cool the roof of furnaces for melting metals, particularly electric arc furnaces.

The invention is applied mainly in electric arc furnaces employed in steel plants to melt metals, whether they be AC or DC.

BACKGROUND OF THE INVENTION

The state of the art includes cooled roofs used to cover electric arc furnaces, which have a central aperture to position and move the electrodes, and a peripheral aperture, or fourth hole, to suck fumes and volatile slag from the inside and discharge them from the furnace.

The systems to cool the roofs use pipes structured in panels in which cooling fluid circulates; this prevents the roof from overheating and prevents wear and damage.

One problem in conventional cooling systems is that there is not a uniform distribution of the temperatures which develop on the inner surface of the roof. In fact, the temperatures which develop on the central part, where the electrodes are located, are much higher than those which develop in the peripheral part of the roof.

Moreover, the temperature of the roof in proximity with the aperture to discharge the fumes is much higher than that which develops in the zone diametrically opposite, and it progressively increases as it gets closer to said aperture due to the flow of incandescent fumes conveyed towards this zone. Due to the presence of intake systems connected to the fourth hole, there is a concentrated intake on a limited part of the volume of the furnace, with consequent localized wear and deterioration.

Conventional cooling systems do not always ensure an effective heat protection which will prevent localized wear in those parts most subject to overheating.

Moreover the coefficient of heat flow removal given by such conventional systems is uniform over the whole surface of the roof; consequently a removal coefficient has to be guaranteed over the whole roof which will be at least equal to that required in the zone where the highest temperatures are reached, that is to say, near the fourth hole.

As a consequence, for a large part of the inner surface of the roof, the cooling system is oversized, which implies a high energy consumption and an excessive quantity of cooling fluid, whereas the hottest zones always work at a very high temperature, with the risk of breakages and malfunctions of the cooling pipes.

The conduits wherein the cooling fluid circulates, as made in the state of the art, can have a ring-shaped or helical circular development or a radial development from the center of the roof towards the periphery or vice versa.

However, such conduits have a structure arranged on a single horizontal plane cooperating with the inside of the roof and in particular with the zone surrounding the electrodes; this does not permit a sufficient accumulation of insulating material, such as slag or otherwise, which can assist said panels in their cooling action and heat insulation.

A further problem which conditions the working life of roofs is that the lining which covers the central part of the roof can be damaged by the heat radiated by the electrodes.

The present Applicant, in the patent applications EP-A-805.325 and PCT/IB00/00035, proposed cooling devices for the roof of electric arc furnaces which solve some of the shortcomings explained above.

This invention has been devised, tested and embodied in order to further perfect conventional cooling devices and to obtain other advantages as identified hereafter.

SUMMARY OF THE INVENTION

The purpose of the invention is to achieve a device to take in fumes and cool the roof for electric furnaces which will allow to obtain an optimum heat insulation, and hence a better performance of the furnace, with reduced management costs and reduced risks of localized deterioration.

A further purpose is to achieve an intake and cooling device with a much lesser risk of breakages compared with conventional systems, particularly in the central part of the roof which comprises and surrounds the aperture through which the electrodes are introduced, thus allowing to reduce stoppages between one cycle and the other to carry out repairs.

To be more exact, one purpose of the invention is to make possible not to use refractory material in the zone of the roof surrounding the electrodes.

Another purpose is to guarantee a homogeneous and uniform fume intake for the whole volume of the furnace, avoiding those problems deriving from having an intake concentrated in a small zone.

A further purpose is to reduce to a minimum, and even prevent, the possibility that fumes should emerge from the apertures around the electrodes from inside the furnace, or that air should enter the furnace from outside; this allows to increase and make the intake uniform around the electrodes.

The intake and cooling device according to the invention, in a preferential embodiment, substantially consists of three distinct systems which cooperate with each other:

- a first cooling system to cool the central zone of the roof, cooperating with the aperture through which the electrodes are introduced,
- a second system able to take in and convey the fumes arriving from the first system, and
- a third system able to cool the peripheral part comprised between the central zone and the outer perimeter.

The first cooling system, according to a first characteristic of the invention, has cooling pipes arranged in such a manner as to create a cyclone spiral, substantially vertical and ring-shaped, which surrounds and cools the zone around the aperture through which the electrodes are introduced and moved.

According to a variant, this spiral partly surrounds the electrodes.

According to another variant, the cooling pipes are made of a material resistant to high temperatures.

This cyclone spiral allows on the one hand to prevent the fumes from emerging outside from the apertures which surround the electrodes, and on the other hand allows to make the intake action around the electrodes uniform, over the whole circumference of the roof.

Moreover, the spiral conformation of the pipes allows to position the pipes in close proximity to the electrodes.

In a first embodiment of the invention, this first cooling system arranged in the central part of the roof is autonomous with respect to the main fume transport system which is connected to the fourth hole of the furnace and is associated with its own means to take in and discharge the fumes.

In another embodiment, this first cooling system is connected to the main intake and discharge system by means of a connection conduit.

According to a variant, this connection conduit is cooled. According to another variant, this connection conduit includes means to regulate and balance the flow, for example grids or gates, either fixed or movable.

In a first embodiment, the connection conduit is inside the furnace while, according to a variant, it is at least partly outside the furnace.

In a preferential embodiment of the invention, this cyclone spiral has a pitch between the pipes which can vary along its circular development; to be more exact, this pitch is at its minimum, that is to say, the distance between the turns is less, in correspondence with the position of the fume-discharge aperture, and is at its maximum, that is to say, with a greater distance between the turns, in a diametrically opposite position.

This variability of the pitch allows maintaining the intake of the fumes, from inside the furnace towards the outside of the central spiral, as uniform as possible, at a substantially constant value. This allows to make the temperatures of the roof substantially uniform, preventing the zone in proximity with the discharge aperture from being subjected to higher heat loads due to the intense flow of fumes conveyed towards said zone.

To be more exact, the variability in the density of the turns allows to correlate the entity of the cooling action to the higher or lower temperatures which develop in the specific zones of the roof, thus allowing the obtaining of energy savings and in general savings in the management costs of the cooling device. This solution also allows sizing the cooling action of the cooling device better, at the same time keeping a high level of safety and efficiency.

The spiral can be substantially of any shape, provided that it can define at least a collector system to collect and subsequently discharge the fumes with a cyclone development.

According to another characteristic of the invention, on its inner surface exposed to the electrodes, the central spiral has at least one and advantageously two circular pipes arranged on a substantially horizontal plane. The pipes encourage a layer of protective slag to form which melts, in the event of discharges of the electric arc from the electrodes towards the pipes, and creates a protective screen which prevents the pipes from being destroyed.

According to one embodiment of the invention, in cooperation with the inner wall of the cyclone spiral there is at least one cooling system, for example of the type conventionally known as microspray, which acts on the electrode, or on the electrodes, in order to reduce the surface oxidation thereof.

According to another characteristic, the central spiral is covered at the upper part by at least a layer of high-density concentric pipes. The function of the pipes is to protect the spiral from the superheating caused by the irradiance of the heat from the electrodes when they are raised to be removed from the furnace, or simply to be moved between one melting cycle and the next or during the melting cycle itself. According to a variant, the layer of concentric pipes can be replaced, either partly or totally, by a layer of refractory material.

The second system to take in and convey the fumes comprises a series of cooling pipes, arranged coaxial and superimposed so as to create a cooled channel through which the fumes pass, and a cooled conduit of cooling pipes. According to a variant, this conduit is not cooled.

The conduit then connects with the main cooled conduit through which the fumes are conveyed towards the intake and filter systems.

The fumes conveyed through the cyclone spiral can be directed inside this cooled conduit to then be discharged.

According to one embodiment of the invention, at inlet to the main conduit there are means to regulate the flow, for example a movable gate, a grid, fixed or movable, or other suitable means. The function of these means to regulate the flow is to balance the delivery of the flow, facilitating a more uniform and less turbulent discharge.

According to a variant, the fumes conveyed through the cyclone spiral are directed towards an independent discharge conduit, which can be cooled or not.

The third cooling system to cool the peripheral part of the roof has a plurality of radial turns, lying on a substantially vertical plane and with a substantially trapezoid or triangular section. The turns are cooling pipes which define a circular transit channel for the discharge fumes, to convey them towards the discharge aperture.

There are cooling pipes cooperating with the radial turns, and above them; they are arranged on a substantially horizontal plane so as to form a plurality of coils each one covering a defined sector of the periphery of the roof.

According to one feature of the invention, the coil-shaped horizontal pipes are arranged in such a manner that the free intake areas enclosed by each sector are all substantially equal to each other. This causes a uniform movement of the discharge fumes along the global surface of the roof and is achieved by making the pipes in such a manner that the distance between the pipes increases from the periphery to the center of the roof.

BRIEF DESCRIPTION OF THE DRAWINGS

These and other characteristics of the invention will become clear from the following description of a preferred form of embodiment given as a non-restrictive example, with the aid of the attached Figures wherein.

DETAILED DESCRIPTION OF A PREFERRED FORM OF EMBODIMENT

Figure 1:
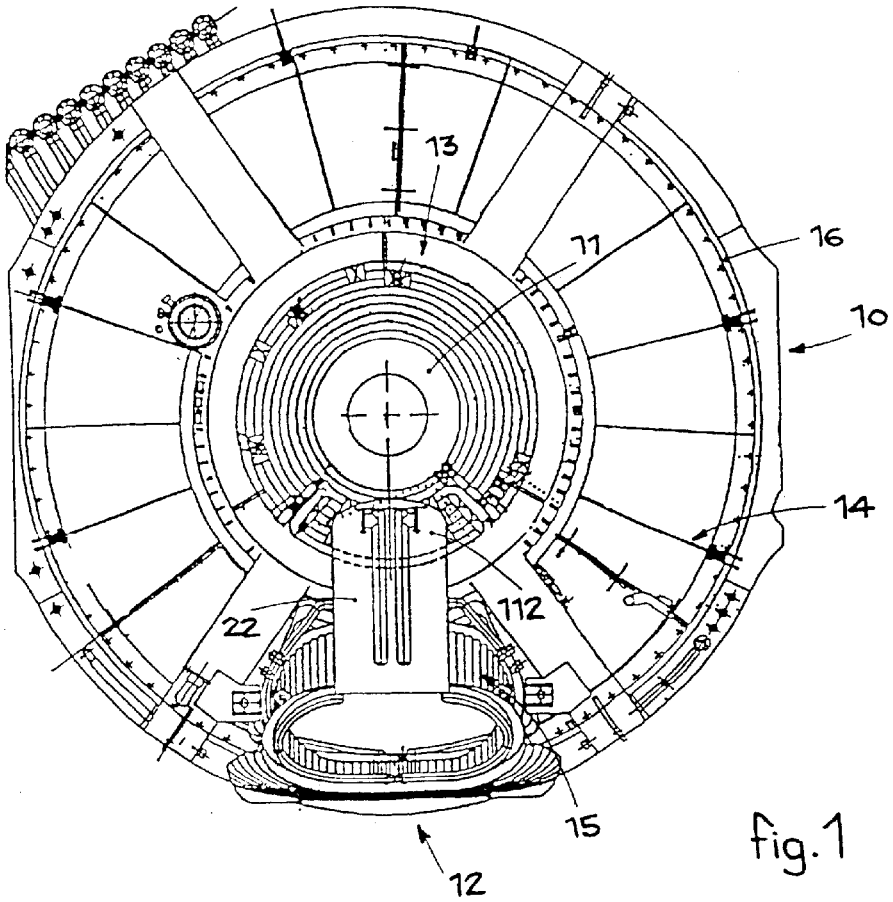
FIG. 1 is a plane view of a roof associated with a device according to the invention.
Figure 2:
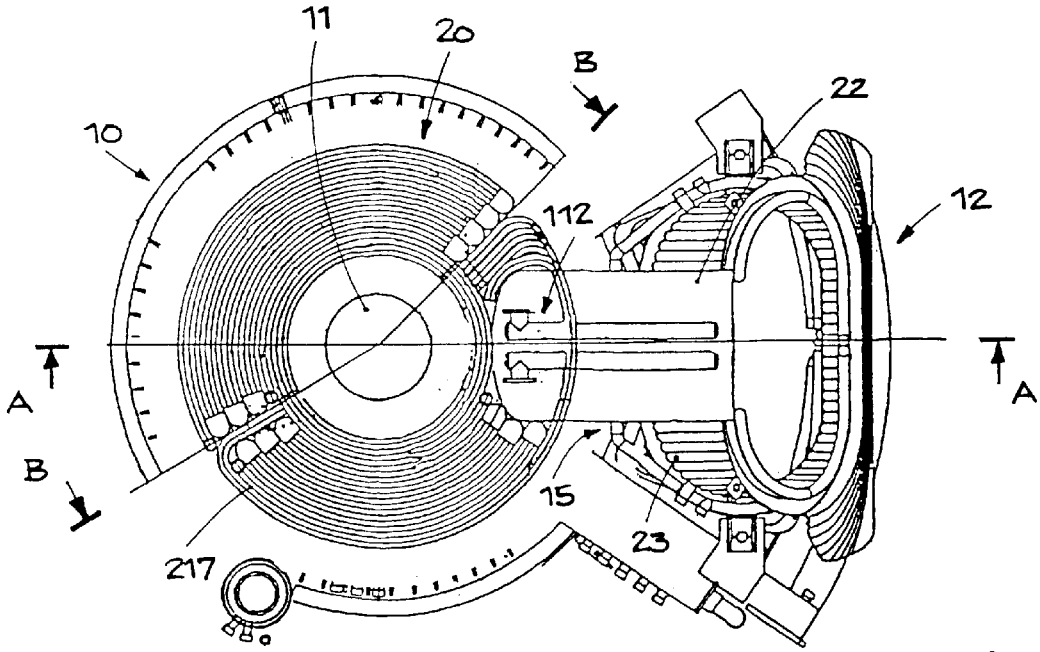
FIG. 2 is an enlarged plane view of the central part of the roof shown in FIG. 1.

In the attached Figures, the reference number 10 denotes a cooled roof for electric arc furnaces in its entirety. The roof 10 comprises a substantially central aperture 11 into which one or more electrodes (not shown here) are inserted and moved, and a peripheral aperture 12, or fourth hole, to take in and discharge the fumes from inside the furnace.

The cooling device for the roof 10 shown in the attached Figures comprises a first system 13 to cool the central zone comprising the aperture 11, a second system 15 to take in and convey the fumes associated with the fourth hole 12 and/or with an autonomous discharge conduit to discharge the fumes to the outside, and a third system 14 to cool the peripheral zone comprised between the central zone and the outer perimeter 16.

Figure 3:
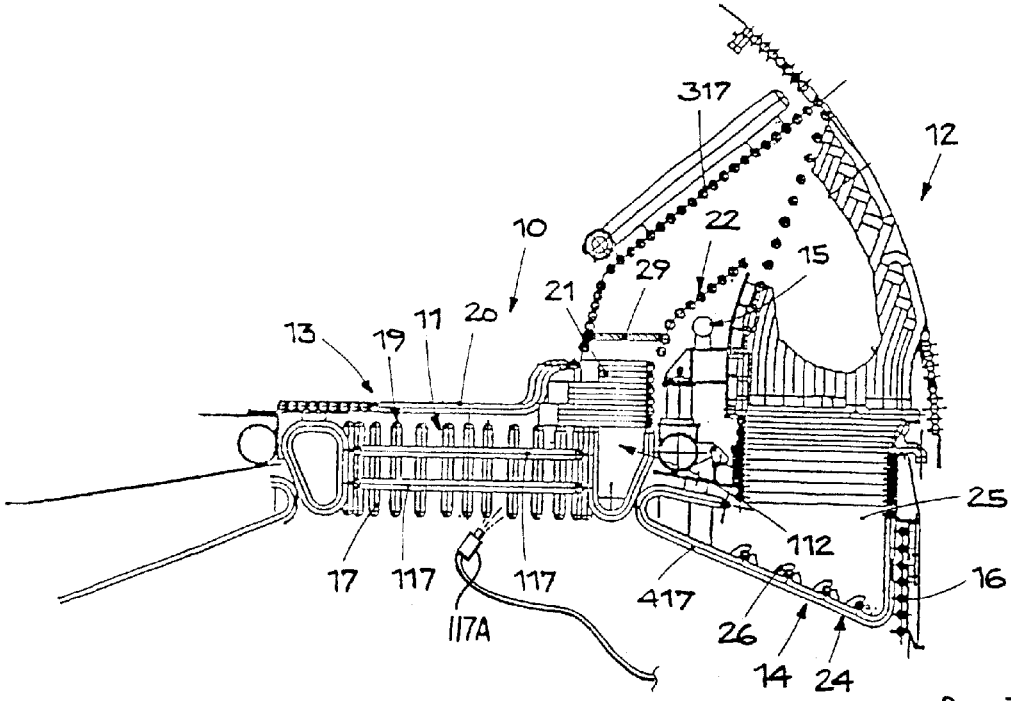
FIG. 3 shows a section from A to A of FIG. 2.
Figure 5:
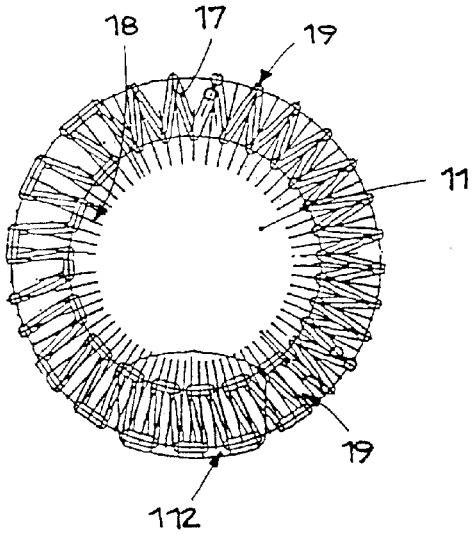
FIG. 5 is a plane view of the detail of the central spiral of the device according to the invention.
Figure 6:
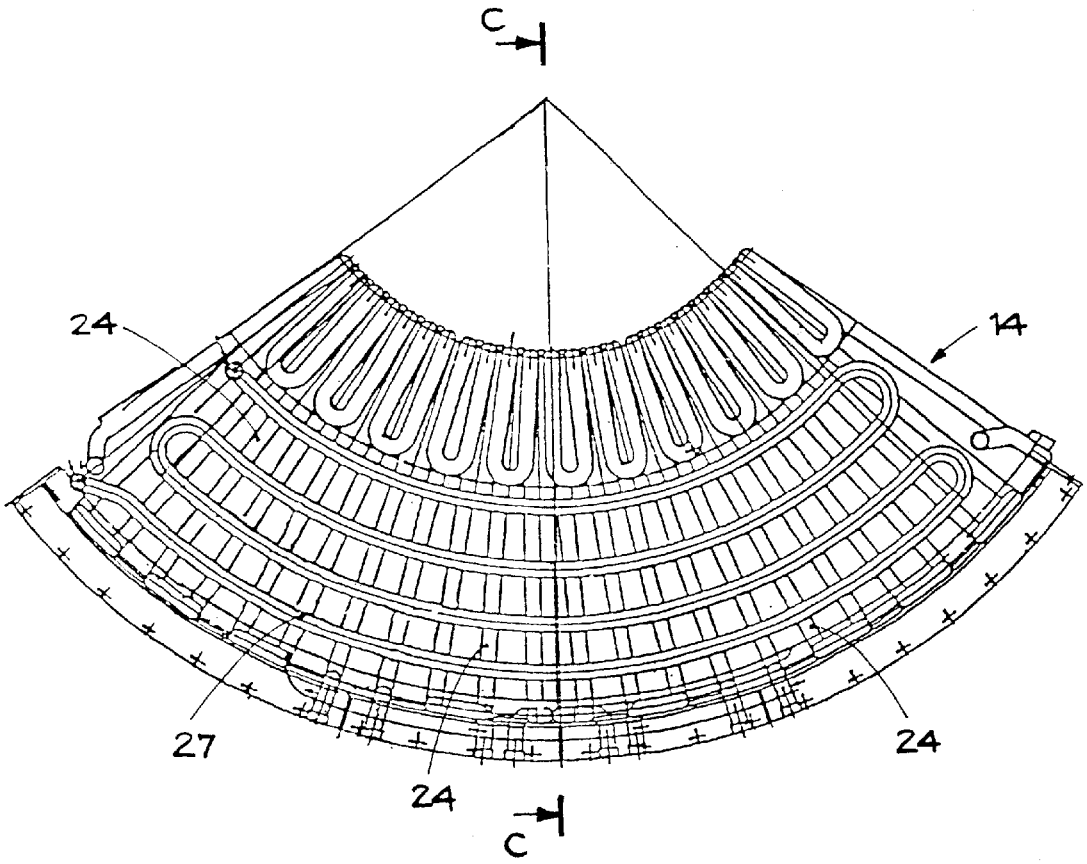
FIG. 6 is a plane view of the detail of the cooling panel associated with the fourth hole.
Figure 7:
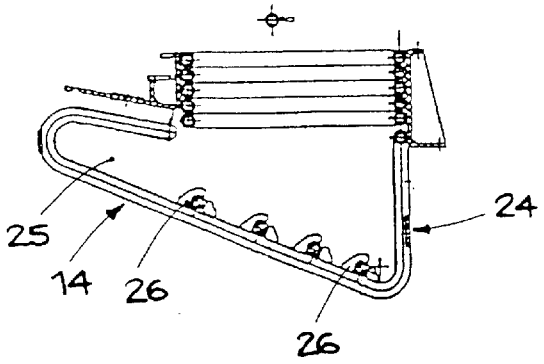
FIG. 7 shows a section from C to C of FIG. 6.

The first cooling system 13 consists substantially of a central chamber comprising cooling pipes 17, arranged in turns 19 lying on a substantially vertical plane and structured as panels, in such a manner as to create an annular-shaped cyclone spiral 18 which at least partly surrounds said central aperture 11 and cools the zone around the electrodes (FIGS. 3 and 5).

The cyclone-type development induced in the fumes collected inside the furnace allows to improve the cooling and reliability of the zone of the roof around the electrode and to prevent or reduce the leakage of fumes and the entrance of air into the furnace from outside, increasing and making the intake uniform around the electrode(s).

In this case, the density of the turns 19 is differentiated along the circumference of the spiral and is at its maximum in correspondence with the aperture 112 through which the fumes are discharged from the spiral, and at its minimum in a diametrically opposite position. This allows to graduate the intensity of the cooling in the zones where it is most required, that is to say, in the part where the flow of incandescent fumes is conveyed due to the action of the intake systems connected to said aperture 112.

This also allows to make uniform the intensity of the flow of fumes exiting from the furnace through the spiral itself.

In one embodiment of the invention, the cyclone spiral 18 is connected to a discharge conduit 22 associated with the peripheral aperture, or fourth hole, 12.

Figure 4:
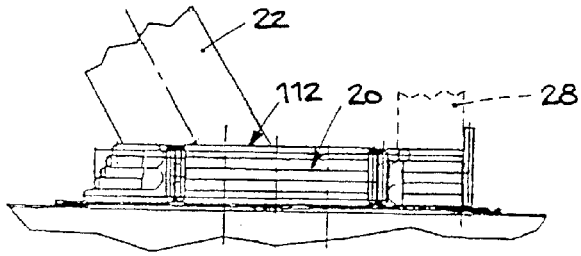
FIG. 4 shows a section from B to B of FIG. 2.

According to a variant, the cyclone spiral 18 constitutes an autonomous system to take in, convey and discharge the fumes, and is connected to its own discharge conduit 28, shown by a line of dashes in FIG. 4, which in this case replaces the conduit 22.

On the inner surface the central chamber comprises a pair of cooling pipes 117 (FIG. 3), arranged in a substantially horizontal ring, the function of which is to encourage the formation of a layer of slag in front of the pipes 17 of the spiral. The layer of slag acts as a protective screen, preventing electric discharges caused by the secondary arcs from damaging and destroying the pipes.

On the inner surface there may also be a cooling system 11 7A which acts on the electrodes and limits the surface oxidation thereof.

Above the central chamber there is, in this case, a substantially horizontal layer 20 of concentric cooling pipes 217 arranged at high density; the function of these pipes 217 is to preserve the pipes 17 of the central spiral 18 from the overheating caused through irradiance of the electrodes during the operations to move the electrodes vertically.

In at least partial substitution of the pipes 217, there may be a layer of refractory material.

The second system 15 to take in and convey the fumes develops from the central chamber, in correspondence with the intake aperture 12.

Said second system 15 comprises a first series of cooling pipes, arranged coaxial and on top of each other to create a cooled channel 21 through which the fumes pass, and a cooled conduit 22 of cooling pipes 317. According to a variant, the conduit 22 is not cooled.

The conduit 22 then connects to the main cooled conduit 23 through which the fumes are conveyed towards the intake and filtering systems.

The fumes conveyed through the cyclone spiral 18 can be directed inside the cooled conduit 22 to then be discharged. According to the embodiment shown, at the inlet to the conduit 22 there are means to regulate the flow, for example a movable gate 29, a grid, fixed or movable, or other suitable means.

The function of these flow-regulation means is to balance the delivery of the flow, facilitating a more uniform and less turbulent discharge thereof.

According to a variant, the fumes conveyed through the cyclone spiral 18 are directed towards the independent discharge conduit 28, which can be cooled or not.

The third cooling system 14 has a plurality of cooling pipes 417, arranged on a substantially vertical plane between the central chamber and the peripheral edge 16 of the roof 10.

The cooling pipes 417 are arranged in such a manner as to form adjacent radial sections 24, substantially triangular or trapezoid in shape, which form an annular channel 25 for the passage of the fumes arranged along the entire circumference of the roof 10. These radial sections 24 are supported by brackets 26 which allow them to be dismantled quickly and easily for maintenance and/or replacement.

Above said adjacent radial sections 24 there are horizontal pipes 27, arranged substantially in a coil, and such as to define circular sectors arranged adjacent to each other so as to cover the entire extension of the roof 10. The horizontal pipes 27 are arranged in such a manner that the free intake areas enclosed by each layer of pipes are as equal in size as possible.

This is obtained by providing the pipes 27 at variable distances from each other, and in particular with an increasing distance from the periphery to the center of the roof 10.

Modifications and variations may be made to the invention without departing from the spirit and scope thereof.

What is claimed is:

1. A device to take in fumes and cool a roof (10) of an electric furnace, said furnace comprising at least a central zone surrounding a substantially central aperture (11) into which at least one electrode can be inserted and moved, and a peripheral fume-discharge aperture (12) to take in and discharge the fumes, said device comprising:

at least a first cooling system (13) for intaking a first portion of the fumes, and cooling the central zone surrounding said central aperture (11), and a second cooling system (15), comprising the peripheral fume-discharge aperture, for intaking, cooling and conveying at least a second portion of the fumes to outside the furnace, wherein said first cooling system (13) comprises at least a circular cyclone chamber (18) comprising a plurality of turns (19) able to cool the central zone surrounding said central aperture (11) and able to create a cyclonic development of the first portion of the fumes.

2. The device as in claim 1, wherein said turns (19) are arranged on a substantially vertical plane to form a ring around said central aperture (11).

3. The device as in claim 1, wherein said turns (19) consist of pipes (17) wherein cooling fluid circulates.

4. The device as in claim 1, wherein said turns are made of material resistant to high temperatures.

5. A device to take in fumes and cool a roof (10) of an electric furnace, said furnace comprising at least a central zone surrounding a substantially central aperture (11) into which at least one electrode can be inserted and moved, and a peripheral fume-discharge aperture (12) to take in and discharge at least a portion of the fumes, said device comprising:

at least a first cooling system (13) for cooling the central zone surrounding said central aperture (11), and a second cooling system (15) to take in and convey the fumes to outside the furnace, wherein said first cooling system (13) comprises at least a circular cyclone chamber (18) comprising a plurality of turns (19) able to cool the central zone surrounding said central aperture (11), wherein said turns (19) comprise pipes (17) wherein cooling fluid circulates, wherein said pipes (17) are arranged to create an annular-shaped cyclone spiral, wherein the density of said turns (19) of said cyclone chamber (18) is at a maximum in substantial correspondence with an aperture (112) through which the fumes are discharged from the cyclone chamber (18), and at a minimum in a diametrically opposite position.

6. The device as in claim 1, wherein a plurality of cooling pipes (117) is arranged on a substantially horizontal plane in cooperation with an inner surface of said cyclone chamber (18) facing towards the at least one electrode.

7. The device as in claim 6, wherein said cooling pipes (117) are shaped in a ring and are arranged coaxial one above the other in cooperation with said inner surface of said cyclone chamber (18).

8. The device as claim 1, wherein at least a cooling device, to cool the surface of said at least one electrode, is arranged in cooperation with an inner surface of said cyclone chamber (18).

9. The device as in claim 8, wherein said cooling device is a microspray cooling device.

10. The device as in claim 1, wherein at least a layer (20) of cooling pipes (217) is arranged on a substantially horizontal plane above said cyclone chamber.

11. The device as in claim 10, wherein said layer (20) of cooling pipes (217) comprises a plurality of pipes (217) arranged concentric and with a high density with respect to each other.

12. The device as in claim 1, wherein the first cooling system comprises a cooled conduit (22) for conveying fumes from the first cooling system to the second cooling system wherein said second cooling system (15) is able to convey fumes to said peripheral fume-discharge aperture (12) and comprises a series of cooling pipes arranged coaxial and one above the other so as to create a cooled channel (21) through which the fumes pass, and the cooled conduit (22), comprises cooling pipes (317) arranged in a spiral and is associated terminally with a cooled fume-discharge conduit (23).

13. The device as in claim 12, wherein said second system (15) to take in and convey fumes is associated, by means of the cooled conduit (22), with said peripheral fume-discharge aperture (12).

14. The device as in claim 12, wherein said first cooling system to take in and convey fumes comprises an autonomous fume-discharge conduit (28) for discharging fumes from the first cooling system to outside the furnace.

15. The device as in claim 12, wherein means (29) to regulate the flow of fumes is arranged between an outlet of said cyclone chamber (18) and an inlet to said cooled conduit (22).

16. The device as in claim 15, wherein said flow regulation means (29) comprise a movable gate.

17. The device as in claim 15, wherein said flow regulation means (29) comprise a fixed grid.

18. A device to take in fumes and cool a roof (10) of an electric furnace, said furnace comprising at least a central zone surrounding a substantially central aperture (11) into which at least one electrode can be inserted and moved, and a peripheral fume-discharge aperture (12) to take in and discharge at least a portion of the fumes, said device comprising:

at least a first cooling system (13) for cooling the central zone surrounding said central aperture (11), and a second cooling system (15) to take in and convey the fumes to outside the furnace, comprising a third system (14) to cool the peripheral part of the roof (10), wherein said third cooling system (14) comprises a plurality of cooling pipes (417) arranged on a substantially vertical plane between said central cyclone chamber (18) and a perimeter edge (16) of said roof (10), said pipes (417) being configured to form adjacent sections (24), substantially triangular or trapezoid in shape, defining an annular channel (25) for passing the fumes therethrough.

19. The device as in claim 18, wherein said third cooling system (14) further comprises a plurality of cooling pipes (27) lying on a substantially horizontal plane above said sections (24) and arranged at a distance from each other which increases from the periphery to the center of the roof (10) to achieve free intake areas for the fumes to pass which are as equal as possible.

20. The device as in claim 1, wherein said turns (19) comprise pipes (17) wherein cooling fluid circulates.

21. The device as in claim 1, wherein the first cooling system comprises a cooled conduit (22) for conveying fumes from the first cooling system to the second cooling system.

* * * * *